US011338187B2

(12) United States Patent
Lee

(10) Patent No.: US 11,338,187 B2
(45) Date of Patent: May 24, 2022

(54) GOLF CLUB FOR PRACTICING SWINGS

(71) Applicant: Doo Hee Lee, Daegu (KR)

(72) Inventor: Doo Hee Lee, Daegu (KR)

( * ) Notice: Subject to any disclaimer, the term of this patent is extended or adjusted under 35 U.S.C. 154(b) by 0 days.

(21) Appl. No.: 16/619,005

(22) PCT Filed: Mar. 30, 2018

(86) PCT No.: PCT/KR2018/003750

§ 371 (c)(1),
(2) Date: Dec. 3, 2019

(87) PCT Pub. No.: WO2019/004569

PCT Pub. Date: Jan. 3, 2019

(65) Prior Publication Data

US 2021/0077881 A1 Mar. 18, 2021

(30) Foreign Application Priority Data

Jun. 29, 2017 (KR) ..... 10-2017-0082536

(51) Int. Cl.
*A63B 69/36* (2006.01)

(52) U.S. Cl.
CPC ..... *A63B 69/3632* (2013.01); *A63B 69/3638* (2013.01); *A63B 2209/00* (2013.01)

(58) Field of Classification Search
CPC ..... A63B 69/3632; A63B 69/3638; A63B 2209/00; A63B 2209/10; A63B 2209/08; A63B 60/02; A63B 2053/0491; A63B 53/04
USPC ..... 473/226
See application file for complete search history.

(56) References Cited

U.S. PATENT DOCUMENTS

D209,294 S * 11/1967 Hitt ..... D21/745
3,637,218 A * 1/1972 Carlino ..... A63B 53/02 473/325
4,030,766 A * 6/1977 Derr ..... A63B 53/047 473/249

(Continued)

FOREIGN PATENT DOCUMENTS

CN 201586358 U 9/2010
KR 10-2003-0010882 A 2/2003

(Continued)

OTHER PUBLICATIONS

KR Notification of Reason for Refusal dated Jun. 19, 2018 as received in Application No. 10-2017-0082536.

(Continued)

*Primary Examiner* — Nini F Legesse
(74) *Attorney, Agent, or Firm* — Maschoff Brennan

(57) ABSTRACT

The present invention relates to a golf club for practicing swings which enables learning a smooth rhythmic sensation under the concept of hitting a ball with a sphere having a metal texture, so as to maintain a stable swing track involving proper rhythm in real swings to correctly send a ball to a desired position. The golf club for practicing swings comprises: a shaft provided with a handle at the top end; and a head coupled to the bottom end of the shaft, wherein the sphere providing a metallic material sensation is integrally formed with the face of the head or detachably formed on the head, thereby providing an image of softly hitting a ball with the sphere made from the metallic material during practice swings.

1 Claim, 4 Drawing Sheets

(56) References Cited

U.S. PATENT DOCUMENTS

| | | | | |
|---|---|---|---|---|
| 4,588,191 | A | 5/1986 | Stewart | |
| 6,780,119 | B1 * | 8/2004 | Gankas | A63B 69/3685 473/236 |
| 6,821,212 | B2 * | 11/2004 | Fowler | A63B 69/3632 473/236 |
| 7,104,897 | B2 * | 9/2006 | Park | A63B 15/00 473/219 |
| D750,718 | S * | 3/2016 | Stephens | D21/791 |
| 9,302,169 | B2 * | 4/2016 | Lee | A63B 53/06 |
| 2006/0183562 | A1 * | 8/2006 | Hill, IV | A63B 69/3685 473/236 |
| 2008/0188319 | A1 * | 8/2008 | Bertolino | A63B 69/3638 473/226 |
| 2017/0157487 | A1 | 6/2017 | Faucette | |

FOREIGN PATENT DOCUMENTS

| | | | |
|---|---|---|---|
| KR | 10-2007-0013869 | A | 1/2007 |
| KR | 10-0709302 | B1 | 4/2007 |
| KR | 100709302 | B1 | 4/2007 |
| KR | 10-2011-0053650 | A | 5/2011 |
| KR | 20-0463887 | Y1 | 12/2012 |

OTHER PUBLICATIONS

KR Notification of Reason for Refusal dated Aug. 22, 2018 as received in Application No. 10-2017-0082536.
KR Grant of Patent dated Nov. 26, 2018 as received in Application No. 10-2017-0082536.

* cited by examiner

GOLF CLUB FOR PRACTICING SWINGS

TECHNICAL FIELD

The present disclosure relates to a golf club for practicing swings, and more particularly, to a golf club for swing practice improved to facilitate swing practice by providing an image and stimulating the imagination of a user.

BACKGROUND ART

Golf is one of the sport that is played in a manner that a ball in a tee box provided on one side of a hole is hit with the longest driver among golf clubs, then a second shot and a third shot are performed, if necessary, using wood or iron to send the ball to a position on or near the green on the opposite side of the tee box, and an approach shot is performed near the green to place the ball on the green, and a putter is sued to put the ball on the green in the hole.

In order to play golf as described above, a swing using a golf club is required. For such a swing, it is very important to maintain a swing posture that leads to a back swing, an impact, and a follow through. Accordingly, in the golf swing practice, it is important to maintain the correct swing position to achieve the correct hit.

For this reason, in order to obtain accurate and consistent swinging movements, swing practices with clubs are continuously performed. However, if a user has his or her shoulder braced or fails to make a smooth swing in impacting the ball, his or her head will turn and face upward according to turn of the body, which is called a head up effect, even before the user hits the ball. Thereby, the user fails to hit the ball correctly.

In particular, the beginners cannot accurately recognize whether the head up effect occurs after hitting the ball or before hitting the ball. Therefore, there is an urgent need for a golf club for a practice that ensures that the user can accurately see the ball when the ball is impacted. Various clubs, tools or devices for practices have been developed and provided.

According to one conventional art, a shaft may have a grip fixed to an upper end thereof and a head weight fixed to a lower end thereof, and a weight is movably inserted into the shaft and fixed with a bolt.

According to another conventional art, a golf club may include a practice part including a shaft formed on one side of a practice head formed by a head weight, a practice grip formed on an opposite side of the shaft, a weight grip formed on one side of the shaft, and a coupling means provided to an opposite side end of the shaft, and a weight part provided with a weight head having an adjustable weight and coupled to the opposite side of the practice part by a coupling means.

According to further conventional art, a golf club may include a grip formed at an upper portion of the shaft, a club coupled to a lower portion of the shaft, and an accommodation groove formed inside the club head and having an open top, wherein a substrate having an LED lamp, a battery, and an impact sensor connected by an electrical circuit is covered by a tubular shock absorption member and is inserted into the accommodation groove such that the LED lamp is turned on by a signal of the impact sensor when the club head hits a golf ball.

In a further conventional art, a transparent cap may be coupled to the inlet of the accommodation groove, threaded portions may be formed on the transparent cap and the inlet of the accommodation groove, respectively, so as to be screw-coupled to each other, and a narrow groove may be formed in the upper surface of the transparent cap such that the transparent cap can be easily rotated by a tool such as a screwdriver or a coin.

DISCLOSURE

Technical Problem

Golf clubs for swing practice to which the conventional technology as described above include a club type provided with a weight heavier than a typical head weight of a golf club to make a user feel the head weight while performing a swing motion without actually hitting a ball, then a club type having a lighting means that allows a user to visually confirming the time when the ball is hit in the swing motion to prevent the head-up effect.

However, with the former type, when a user actually practices hitting a ball with a club after performing an idle swing with a practice tool or club having to a weight, the user who is not familiar with the difference in weight between the club and the practice tool may fail to obtain a correct sense of rhythm due to the increased speed of the head, thereby losing the balance in the swing motion.

The latter club type allows the user to visually check the lighting means in hitting the ball. However, when the user actually practices hitting a ball with the club, the user cannot visually check the hitting time, and thus his or her head cannot be prevented from turning up before the ball is hit. Accordingly, the latter type also fails to obtain a substantial effect.

In addition, no matter how many times a user practices swings using a practice tool, the user who practices hitting a ball with a real club is obsessed with the idea that the user should hit the ball by the face of the club, and tends to hit the ball hard using the wrist or other part of the user's body as the user instinctively tries to hit the ball with the flat face of the club.

Since the face that the ball actually comes into contact is flat as described above, the hands and arms holding the club fails to naturally swing toward the position of the ball by loosening the body twisted in the backswing process even when the ball and face come into view during the impact motion in the swing process as the hands and arms are more braced. Accordingly, it is difficult to maintain the correct position and the direction in which the ball is hit is not consistent. There are many other issues.

Technical Solution

In accordance with one aspect of the present disclosure devised to solve the problems as described above, provided is a golf club for swing practice including a shaft having a grip at an upper end thereof, and a head coupled to a lower end of the shaft.

Herein, a metallic spherical body is integrally provided to the head or a spherical body having a metallic texture is detachably provided to the head to provide an image of smooth hitting of a ball with the spherical body in the swing practice.

The golf club for swing practice allows a user to learn a soft rhythm by hitting a ball with a spherical body of a metal texture. Accordingly, even in performing a real swing motion, a stable swing trajectory may be maintained with a normal rhythm, and thus the ball may be sent to a desired position.

Advantageous Effects

According to the present disclosure, a spherical body having a metallic feel is integrally or detachably provided to the face of the golf club. Thus, in the swing practice, users may obtain a feel and an image that the ball is smoothly hit by a heavy spherical body. Accordingly, the effect of unnecessarily controlling or tensioning the physical body may be excluded from the swing motion, and a smooth swing may be induced even when the user hits the ball with a real club.

By providing the image of hitting the ball with a metallic spherical body as described above, the correct swing posture and swing trajectory may be maintained in the swing practice, and the swing speed may be improved. Accordingly, various effects including enhancement of the directionality and driving distance in actually hitting a ball.

BEST MODE

Figure 1:
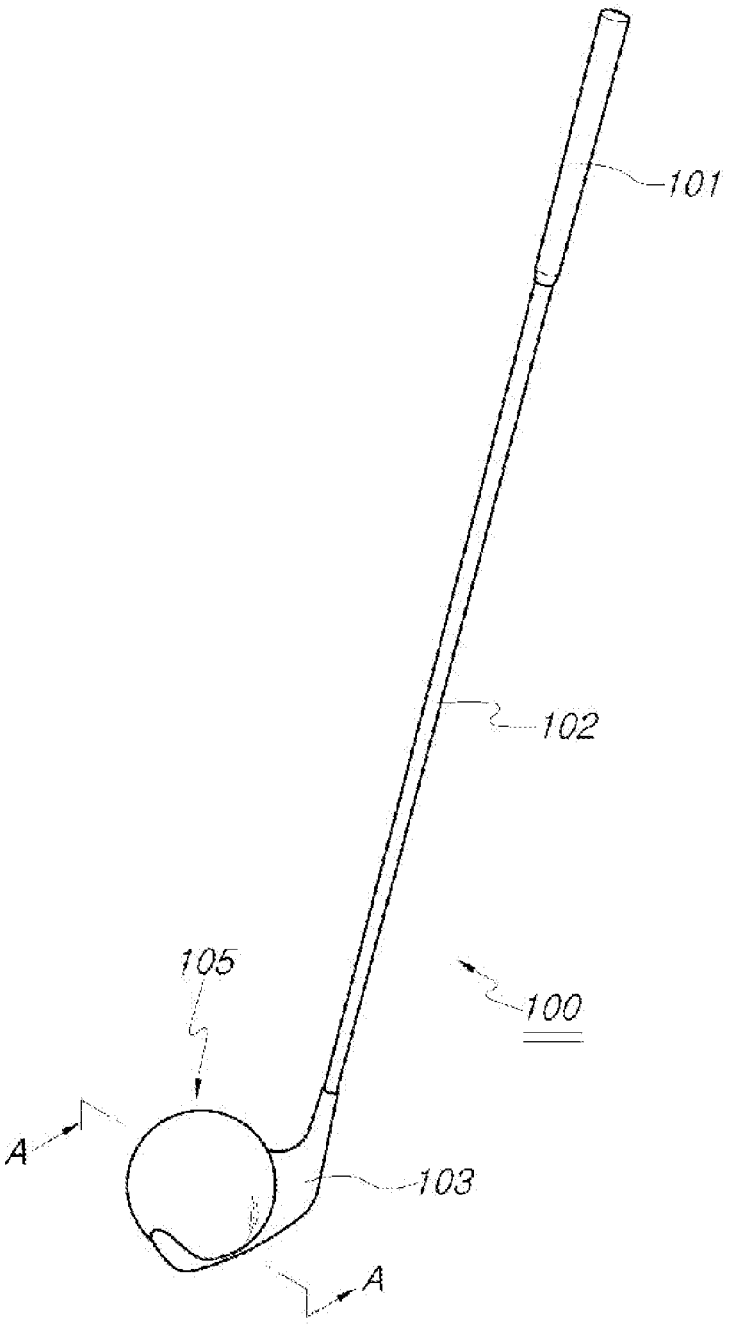
FIG. 1 is a perspective view of a first example showing a golf club for swing practice to which the technique of the present disclosure is applied.
Figure 2:
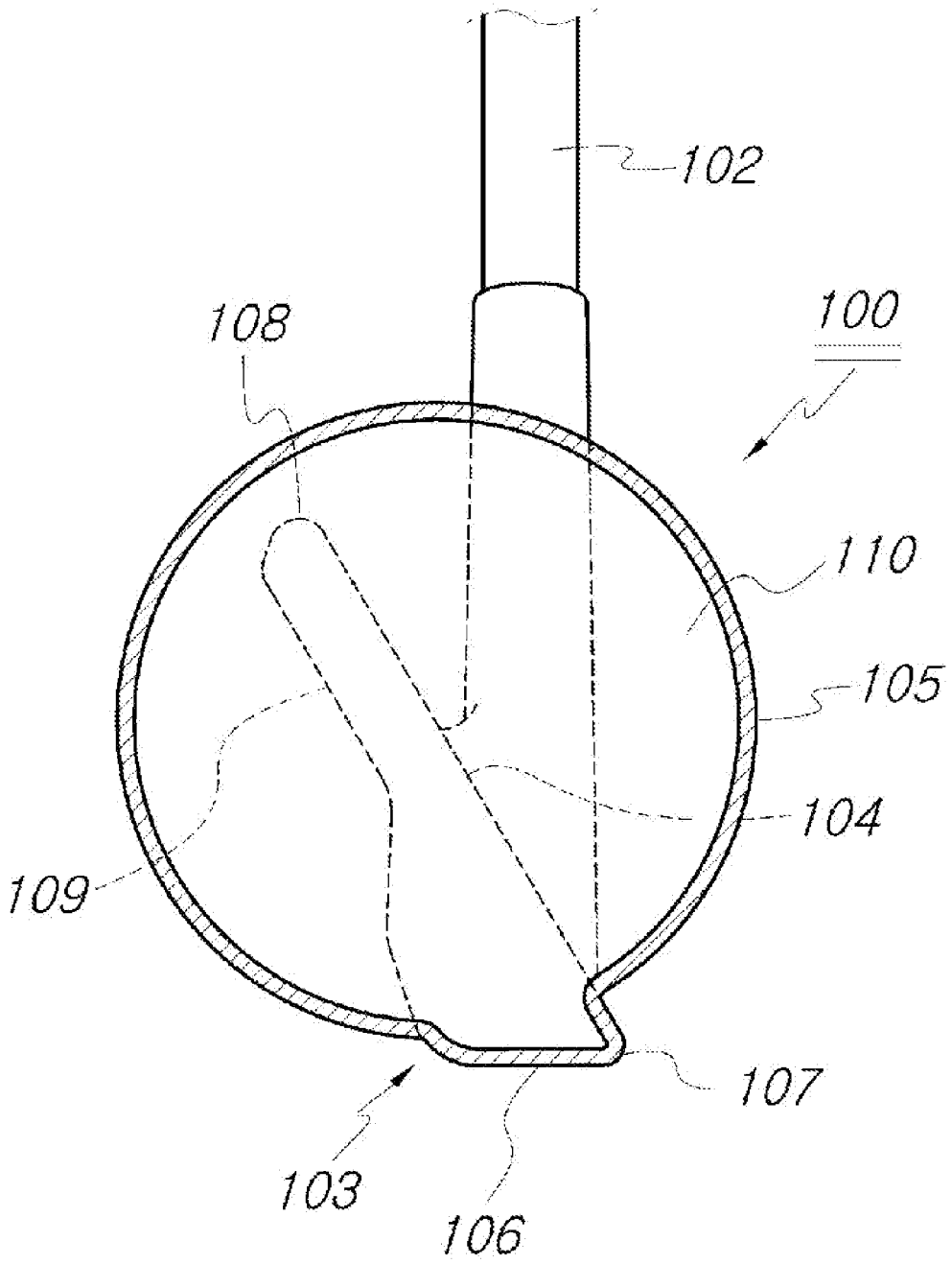
FIG. 2 is a cross-sectional view taken along line A-A of the first example showing the golf club for swing practice to which the technique of the present disclosure is applied.
Figure 3:
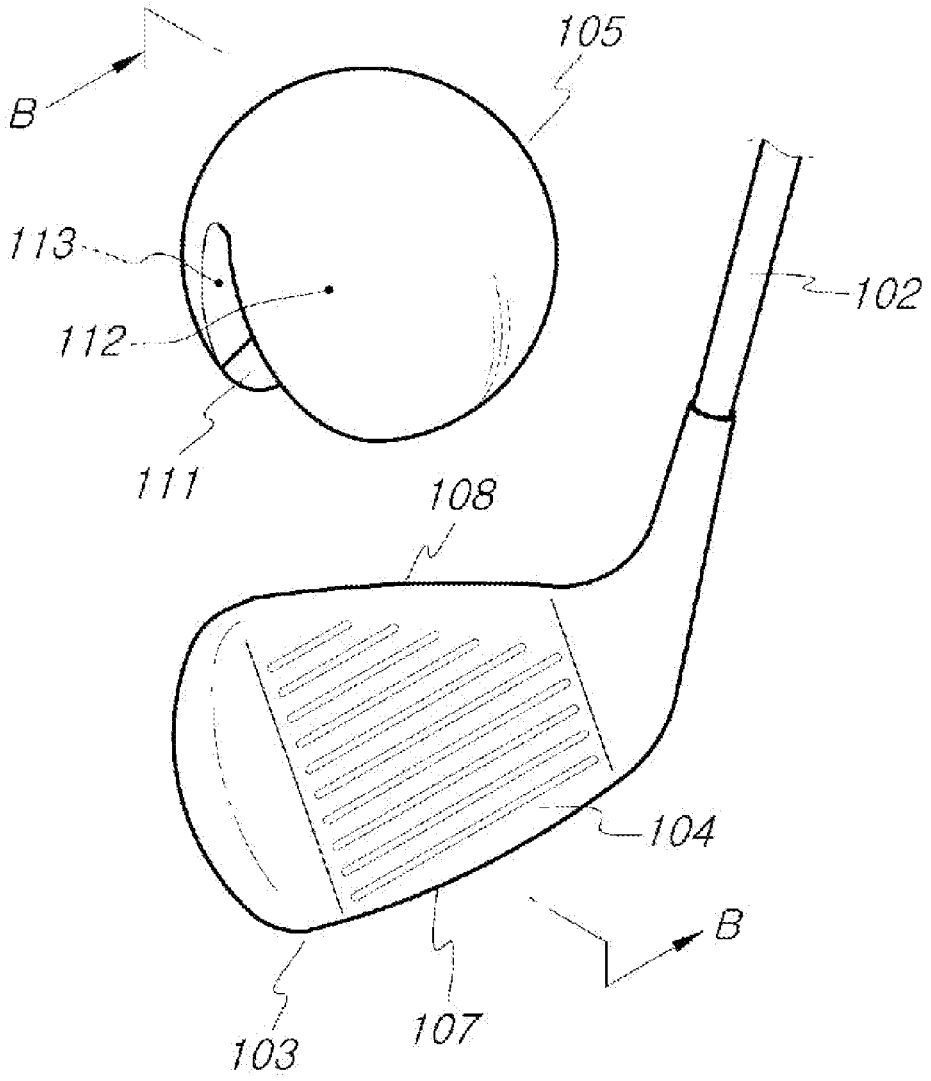
FIG. 3 is an exploded perspective view of a head portion of a second example showing a golf club for swing practice to which the technique of the present disclosure is applied.
Figure 4:
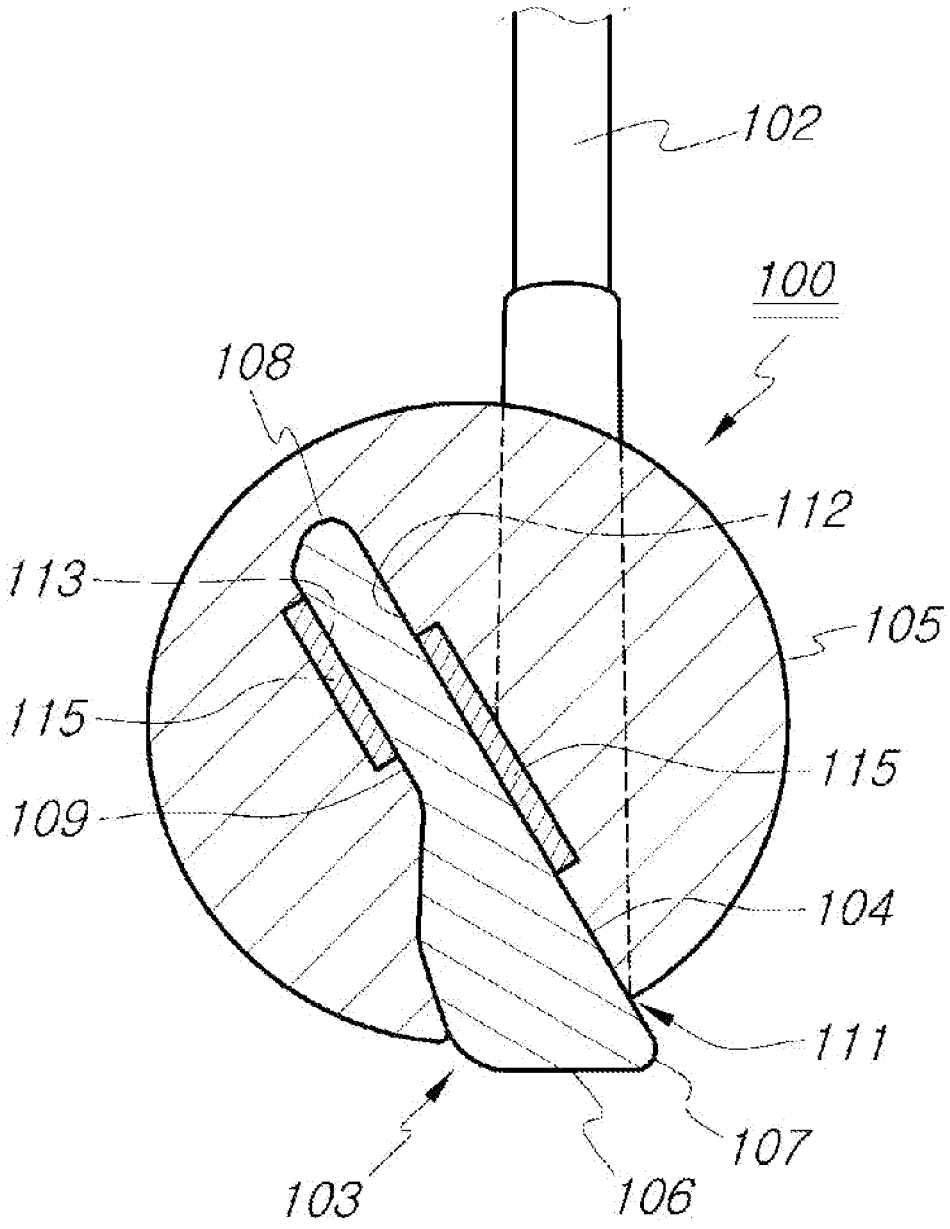
FIG. 4 is a cross-sectional view taken along the line A-A of the second example showing the golf club for swing practice to which the technique of the present disclosure is applied.

A golf club 100 for swing practice to which the technique of the present disclosure is applied includes a shaft 102 having a grip 101 at an upper end thereof, and a head 103 coupled to a lower end of the shaft 102, wherein a spherical body 105 having a metallic texture is integrally or detachably provided to a face 104 of the head 103 to provide an image of smooth hitting of a ball with the metallic spherical body 105 in the swing practice to ensure that a smooth swing and a stable swing trajectory are maintained.

The head 103 may be formed to have the same shape as the head of a club that is actually used by golfers, such as an iron shape, a wood shape, a utility shape, or a driver shape, in order to reduce the sense of difference and repulsion in practicing swings.

In addition, the total weight including the head 103 and the sphere 105 may be set to be actually equal to the weight of the head weight corresponding to each club, such that the user does have the sense of difference in performing a swing with a real club after practicing swings. Both the head 103 and the spherical body 105 are formed of a metal material and a hollow portion may be formed therein to meet a weight. Alternatively, both the head and the spherical body may be formed of plastics or non-ferrous metal and a weight body may be provided therein to meet the weight.

The spherical body 105 may be integrally or detachably provided to the head 103 with the sole 106 and the leading edge 107 of the head 103 may be maintained in a normal shape to prevent the face 104 from being misaligned with the ground (mat) when users grip the golf club 100 or place the club in position in addressing for a swing.

Therefore, the lowermost position of the spherical body 105 is spaced apart from the lower end of the face 104, which is the upper portion of the sole 106, and the uppermost position of the spherical body 105 is located above the topline 108 of the head 103.

As an example of the spherical body 105, a metal material (a material for making a typical golf club, such as general metal and stainless steel) is integrally formed on the face 104 and the back face 109 of the head 103 through casting or die-casting.

Here, a hollow portion 110 may be formed in the head 103 integrally provided with the spherical body 105 to adjust a head weight to have the same weight as the original weight of The head 103 of the golf club 100, such that head weight is within the error range of the weight of the head 103. Thereby, the sense of difference between a practice swing and an actual swing may be excluded.

In order to obtain the head weight of a real golf club, the head 103 may be formed of a non-ferrous metal material rather than a metal material, and then the entirety of the head 103 may be painted in a color of a general golf club.

In another example of the spherical body 105, the spherical body 105 may be formed of a lightweight material such as plastics or synthetic resin to prevent the overall weight from increasing, and a head groove 111 into which the head 103 can be inserted upward from the center bottom of the spherical body 105. The front contact surface 112 and rear contact surface 113 of the head groove 111, which contact the face 104 and back face 109 of the head 103 may be detachably attached to the head 103 using an attachment means 115.

The attachment means 115 may be formed by integrally inserting a magnet into the spherical body 105 or by forming a magnet groove in the spherical body 105 and fixing a magnet with an adhesive.

When the head 103 is of a wood type or driver type, the attachment means 115 having a large size may be arranged at the center of the front and rear contact surfaces 112 and 113 because the spherical body 105 is large. Alternatively, one or more attachment means may be evenly distributed on the front and rear contact surfaces 112 and 113 to enhance the adhesiveness (coupling).

As another example of the attachment means 115, a male-female member such as Velcro is bonded to the head 103 and the spherical body 105 such that the head and the spherical body are detachably attached to each other. However, a magnet may be employed instead of the Velcro because of the swing speed is fast when swings are practiced using the real golf club 100.

Mode for Invention

Swing practices can be performed just like typical swing practices, holding the golf club 100 for the swing practice that has the head 103 integrated with the spherical body 105 or the golf club 100 for the swing practice that has the spherical body 105 coupled to the head 103 using the attachment means 115.

Then, since the configuration provides the head weight of each club, the need for an additional weight is eliminated. Therefore, when a swing is performed with a real club after swing practice, the user can naturally perform a swing as in the swing practice.

In particular, in the swing practice, the spherical body 105 integrated or coupled with the head 103 is visually identified at the impact position, and the spherical body 105 is configured to have a metallic texture. Since the club is perceived to be weighty from the perspective of image thereof and the user's recognition, the user does not feel any need to apply excessive force in the transition from the backswing top to the downswing and at the impact moment in the swing motion. Therefore, a natural swing may be made.

In addition, when the head 103 of the golf club 100 for the swing practice is provided with the spherical body 105, the weight thereof is substantially equal to the weight of the head of each club, but the image of the spherical body 105 alone makes the user feel a metallic texture. Thus, the user may feel like the club is very weighty, and thus may not feel a need to apply excessive force or control his or her body in relation to the swing in the swing motion. Therefore, a natural swing may be implemented.

Therefore, even a swing is performed with a real club after a continuous swing practice, a smooth and natural swing may be implemented without excessive force while maintaining a stable rhythm and swing trajectory. In addition, in the movement of quickly releasing the upper part of the pelvis from the twisted position with respect to the standing lower body, the head speed may be increased and the hands and arms holding the club 100 may be naturally thrown toward the ball position. Therefore, the swing may become simpler and the striking force applied to the ball may be enhanced.

As such, the present invention always makes the user feel the club head weight. Second, for the downswing and impact, the swing can be performed in a manner that the club head weight is dropped to hit the golf ball to send the ball, the disadvantage of swinging by the force of the arm may be overcome.

Third, the swing trajectory of the club head is clearly visible in front of the eyes. Fourth, since a swing is made like movement of an iron ball, the swing trajectory may not be irregular and may be simple. Fifth, in the follow through, the user may obtain the feeling of throwing the club head, and be allowed to make a swing in a manner of throwing the head followed by the user's body without pulling the arms as in the case where a heavy iron ball is thrown.

Sixth, the user may recognize how to loosely hold the grip to hit the ball with the weight of the club head, and it is difficult to control the swing with the force of the arm. Accordingly, it is easy to practice hitting the ball with the force of the lower body or abs.

Mode for Invention

With a golf club for swing practice according to the present disclosure, a user may learn a soft rhythm by hitting a ball with a spherical body of a metal texture. Accordingly, even in performing a real swing motion, a stable swing trajectory may be maintained with a normal rhythm, and thus the ball may be sent to a desired position.

The invention claimed is:

1. A golf club for swing practice comprising:

a shaft having a grip at an upper end thereof; and a head coupled to a lower end of the shaft, wherein:

a metallic spherical body is integrally provided to the head or a spherical body having a metallic character is detachably provided to the head such that a ball is smoothly hit with the spherical body in the swing practice to ensure that a smooth swing, a stable swing trajectory, and a stable swing posture are maintained, the spherical body comprises a head groove allowing the head to be inserted thereinto upward from a bottom center of the spherical body, the head groove comprises a front contact surface and a rear contact surface, the front contact surface and the rear contact surface being arranged to contact a face and a back face of the head and detachably attached to the head using magnets, and a lowermost position of the spherical body is spaced apart from a lower end of a face of the head, the face of the head is an upper portion of a sole of the head, and an uppermost position of the spherical body is located above a top line of the head.

* * * * *